US010889469B2

(12) United States Patent
Eastman et al.

(10) Patent No.: US 10,889,469 B2
(45) **Date of Patent: *Jan. 12, 2021**

(54) WOVEN ELEVATOR BELT WITH COATING

(71) Applicant: OTIS ELEVATOR COMPANY, Farmington, CT (US)

(72) Inventors: Scott Alan Eastman, Glastonbury, CT (US); Michael Paul Humbert, Manchester, CT (US); Daniel A. Mosher, Glastonbury, CT (US); John P. Wesson, West Hartford, CT (US); Wenping Zhao, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 310 days.

This patent is subject to a terminal disclaimer.

(21) Appl. No.: 15/123,116

(22) PCT Filed: Mar. 6, 2014

(86) PCT No.: PCT/US2014/021123

§ 371 (c)(1),
(2) Date: Sep. 1, 2016

(87) PCT Pub. No.: WO2015/134023

PCT Pub. Date: Sep. 11, 2015

(65) Prior Publication Data

US 2017/0101293 A1 Apr. 13, 2017

(51) Int. Cl.

| | |
|---|---|
| ***B66B 7/06*** | (2006.01) |
| ***D07B 1/22*** | (2006.01) |
| ***D07B 1/16*** | (2006.01) |
| ***D07B 5/00*** | (2006.01) |
| ***D03D 1/00*** | (2006.01) |
| ***D03D 15/00*** | (2006.01) |
| ***D03D 15/02*** | (2006.01) |

(Continued)

(52) U.S. Cl.
CPC ..... *B66B 7/062* (2013.01); *D03D 1/0094* (2013.01); *D03D 15/0094* (2013.01);
(Continued)

(58) Field of Classification Search
CPC ..... D07B 2205/3007; D07B 2801/16; D07B 2801/22; D07B 2201/2087;
(Continued)

(56) References Cited

U.S. PATENT DOCUMENTS

| | | | |
|---|---|---|---|
| 2004/0065529 | A1 | 4/2004 | Cediel et al. |
| 2010/0133046 | A1 | 6/2010 | Allwardt et al. |

(Continued)

FOREIGN PATENT DOCUMENTS

| | | | |
|---|---|---|---|
| CN | 101525855 | A | 9/2009 |
| CN | 102575420 | A | 7/2012 |

(Continued)

OTHER PUBLICATIONS

European Search Report for application EP 14884469.9, dated Sep. 25, 2017, 8 pages.

(Continued)

*Primary Examiner* — Arti Singh-Pandey
(74) *Attorney, Agent, or Firm* — Cantor Colburn LLP

(57) ABSTRACT

A method of forming a belt for suspending and/or driving an elevator car includes arraying a plurality of tension elements longitudinally along a belt and interlacing a plurality of warp fibers and a plurality of weft fibers with the plurality of tension elements to form a composite belt structure. A coating is applied to at least partially encapsulate the composite belt structure. The coating includes a base coating material and at least one additive mixed with the base coating material to improve an operational characteristic of the belt.

19 Claims, 7 Drawing Sheets

(51) Int. Cl.
*D07B 5/04* (2006.01)
*B66B 9/00* (2006.01)

(52) U.S. Cl.
CPC ..... *D03D 15/02* (2013.01); *D07B 1/16* (2013.01); *D07B 1/22* (2013.01); *D07B 5/006* (2015.07); *D07B 5/04* (2013.01); *B66B 9/00* (2013.01); *D07B 2201/2087* (2013.01); *D07B 2201/2092* (2013.01); *D07B 2205/3007* (2013.01); *D07B 2401/202* (2013.01); *D07B 2401/2025* (2013.01); *D07B 2401/2035* (2013.01); *D07B 2501/2007* (2013.01); *D10B 2101/20* (2013.01); *D10B 2505/02* (2013.01)

(58) Field of Classification Search
CPC ..... D07B 2201/2092; D07B 2401/202; D07B 2401/2025; D07B 2401/2035; D07B 2501/2007; D07B 1/16; D07B 1/22; B66B 7/062; B66B 9/00; D03D 15/0094; D03D 15/02; D03D 1/0094; D10B 2101/20; D10B 2505/02
See application file for complete search history.

(56) References Cited

U.S. PATENT DOCUMENTS

| | | | | |
|---|---|---|---|---|
| 2012/0195733 | A1 | 8/2012 | Bruch et al. | |
| 2013/0042939 | A1 | 2/2013 | Wesson et al. | |
| 2013/0171463 | A1* | 7/2013 | Chang | B66B 7/062 428/549 |
| 2015/0191331 | A1* | 7/2015 | Orelup | D07B 1/22 428/76 |

FOREIGN PATENT DOCUMENTS

| | | | |
|---|---|---|---|
| EP | 0228725 | A1 | 7/1987 |
| EP | 2560911 | A2 | 2/2013 |
| JP | 2009234791 | A | 10/2009 |
| WO | 03074771 | A1 | 9/2003 |
| WO | 2011142756 | A1 | 11/2011 |
| WO | 2012039781 | A1 | 3/2012 |
| WO | 2013105958 | A1 | 7/2013 |

OTHER PUBLICATIONS

Notification of Transmittal of the International Search report and the Written Opinion of the International Searching Authority, or the Declaration; Application No: PCT/US2014/021123; dated Nov. 26, 2014; 12 pages.
Chinese Office Action Issued in CN Application No. 201480076904.0, dated Mar. 28, 2018, 8 pages.
European Office Action Issued in EP Application No. 14884469.9, dated Sep. 25, 2019, 9 pages.

* cited by examiner 16
32
40
32
40
32
40
32

WOVEN ELEVATOR BELT WITH COATING

CROSS REFERENCE TO RELATED APPLICATIONS

This application is a National Phase Application of Patent Application PCT/US2014/021123 filed on Mar. 6, 2014, the entire contents of this application is incorporated herein by reference thereto.

BACKGROUND OF THE INVENTION

The subject matter disclosed herein relates to tension members such as those used in elevator systems for suspension and/or driving of the elevator car and/or counterweight.

Conventional elevator systems use rope formed from steel wires as a lifting tension load bearing member. Other systems utilize a lifting belt formed from a number of steel cords, formed from steel wires, retained in an elastomeric jacket. The cords act as the load supporting tension member, while the elastomeric jacket holds the cords in a stable position relative to each other, and provides a frictional load path to provide traction for driving the belt.

Still other systems utilize woven belts, in which yarns or other non-metallic fibers are woven together with the steel cords to retain the cords. The woven belt is also saturated or coated with an elastomeric binder. This is done to produce a selected amount of traction between the belt and a traction sheave that drives the belt, while reducing noise that sometimes results from the use of elastomeric belts. The steel cords in the woven belt are the primary load bearing tension members, the yarns and the binder material act to keep the cords in place and provide a traction surface. The use of yarn materials also expands the physical properties of the construction beyond what is possible from thermoplastic or extrudable rubber jacket materials.

BRIEF DESCRIPTION OF THE INVENTION

In one embodiment, a belt for suspending and/or driving an elevator car includes a plurality of tension elements extending longitudinally along a length of the belt and a plurality of warp fibers and weft fibers interlaced with the plurality of tension elements forming a composite belt structure. A coating at least partially encapsulates the composite belt structure. The coating includes a base coating material and at least one additive mixed with the base coating material to improve an operational characteristic of the belt.

Additionally or alternatively, in this or other embodiments the plurality of warp fibers and the plurality of weft fibers are interlaced with the plurality of tension elements by one or more of weaving, knitting or braiding.

Additionally or alternatively, in this or other embodiments the plurality of warp fibers extend longitudinally along the length of the belt and the plurality of weft fibers extend transverse to the plurality of warp fibers at a ninety degree angle to the plurality of warp fibers. An edge fiber extends parallel to the plurality of tension elements.

Additionally or alternatively, in this or other embodiments the plurality of warp fibers and the plurality of weft fibers comprise one or more of nylon, polyester, polyethylene terephthalate, polyether ether ketone, glass, Kevlar® polypara-phenylene terephthalamide, aramid, carbon fiber, or wool.

Additionally or alternatively, in this or other embodiments the base coating material comprises one or more of polyurethane, styrene butadiene rubber (SBR), nitrile rubber (NBR), acrylonitrile butadiene styrene (ABS), SBS/SEBS plastics, silicone, EPDM rubber, or neoprene, each of which can be in the form of a solution, emulsion, prepolymer, or other fluid phase.

Additionally or alternatively, in this or other embodiments the additive is one or more of alumina, silica, titania, graphite or chopped fiber to improve traction performance of the belt.

Additionally or alternatively, in this or other embodiments the additive is one or more of melamine salts, graphene, clay, talc, Al/Mg hydroxide, chopped fiber or exfoliated clay platelets to improve fire resistance of the belt.

Additionally or alternatively, in this or other embodiments the additive is one or more of zinc powder, graphene or exfoliated clay platelets to improve corrosion resistance of the belt.

Additionally or alternatively, in this or other embodiments the additive is one or more of chopped fiber, alumina, silica, carbon black, carbon nanotubes, or clay to improve mechanical performance of the belt.

Additionally or alternatively, in this or other embodiments the additive is one or more of carbon black, graphene or carbon nanotubes to improve UV resistance of the belt.

Additionally or alternatively, in this or other embodiments the plurality of tension elements are a plurality of steel cords.

In another embodiment, a method of forming a belt for suspending and/or driving an elevator car includes arraying a plurality of tension elements longitudinally along a belt and interlacing a plurality of warp fibers and a plurality of weft fibers with the plurality of tension elements to form a composite belt structure. A coating is applied to at least partially encapsulate the composite belt structure. The coating includes a base coating material and at least one additive mixed with the base coating material to improve an operational characteristic of the belt.

Additionally or alternatively, in this or other embodiments the coating is cured by heating and/or drying the belt.

Additionally or alternatively, in this or other embodiments a tension element coating is applied to the plurality of tension elements prior to interlacing the plurality of warp fibers and the plurality of weft fibers therewith.

Additionally or alternatively, in this or other embodiments the coating is applied to the composite belt structure via one of dipping, spraying, rolling, squeezing, blade coating or pulltrusion.

Additionally or alternatively, in this or other embodiments applying the coating includes applying a first coating layer having a first viscosity and applying a second coating layer having a second viscosity greater than the first viscosity.

Additionally or alternatively, in this or other embodiments the first coating layer penetrates the composite belt structure.

Additionally or alternatively, in this or other embodiments the first coating layer is at least partially cured before applying the second coating layer.

Additionally or alternatively, in this or other embodiments the plurality of warp fibers and the plurality of weft fibers are interlaced with the plurality of tension elements by one or more of weaving, knitting or braiding.

Additionally or alternatively, in this or other embodiments the coating is partially cured and a roller is passed over the belt surface to produce a selected surface finish of the coating. The coating is then cured to finish.

BRIEF DESCRIPTION OF THE DRAWINGS

FIG. 4 is a plan view of another embodiment of an elevator belt; and

The detailed description explains the invention, together with advantages and features, by way of examples with reference to the drawings.

DETAILED DESCRIPTION OF THE INVENTION

Figure 1A:
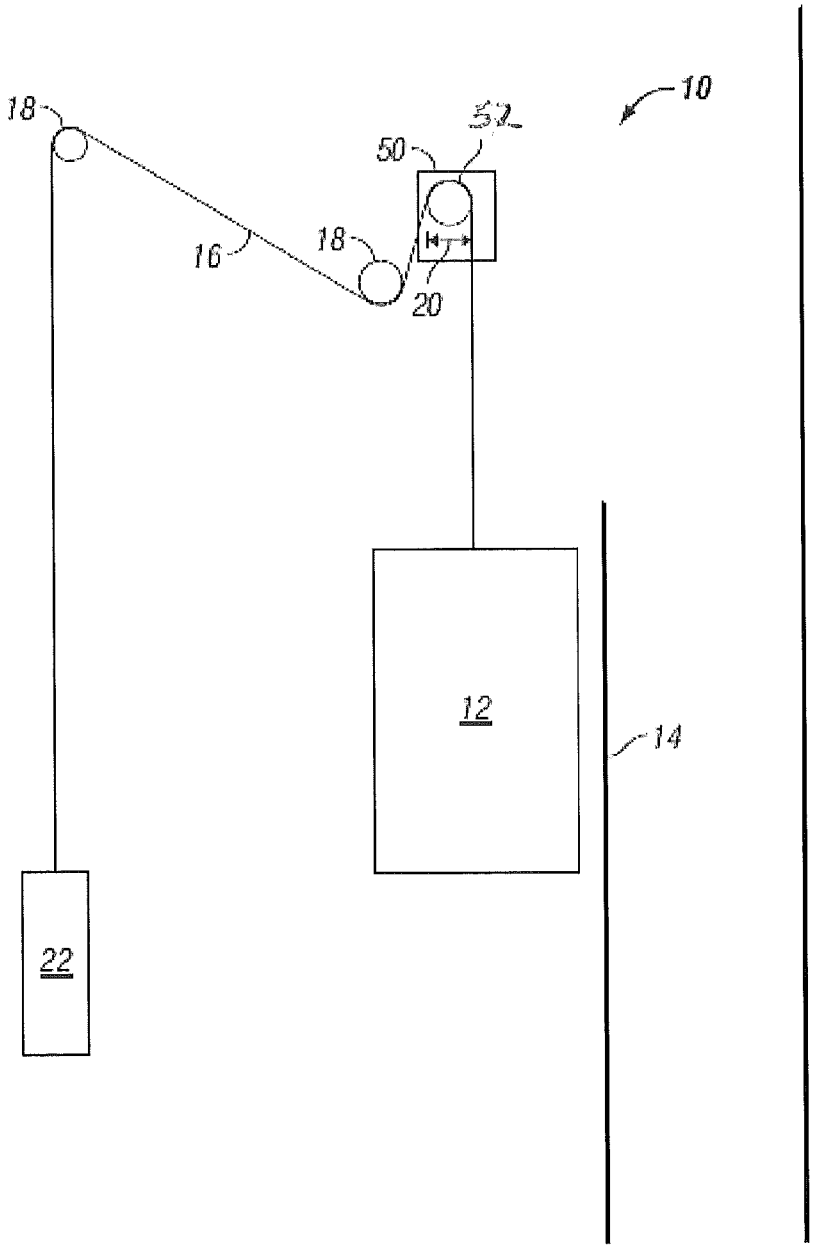
FIG. 1A is a schematic of an exemplary elevator system having a 1:1 roping arrangement.
Figure 1B:
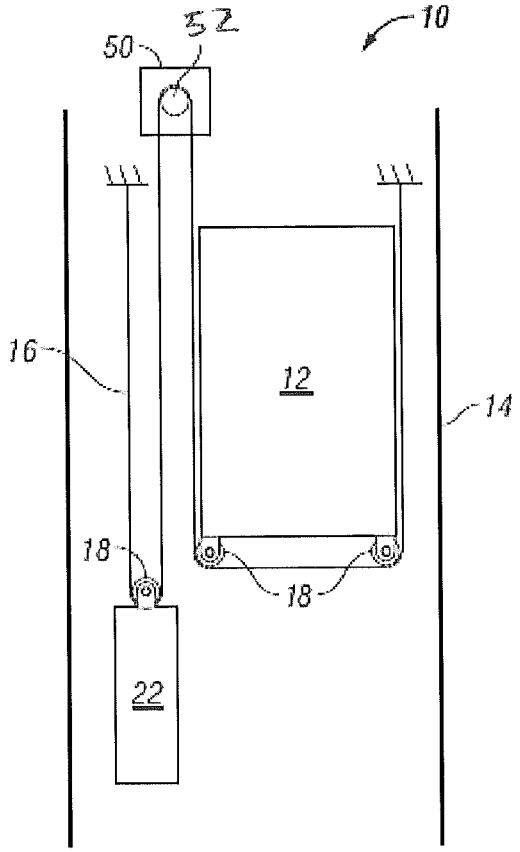
FIG. 1B is a schematic of another exemplary elevator system having a different roping arrangement.
Figure 1C:
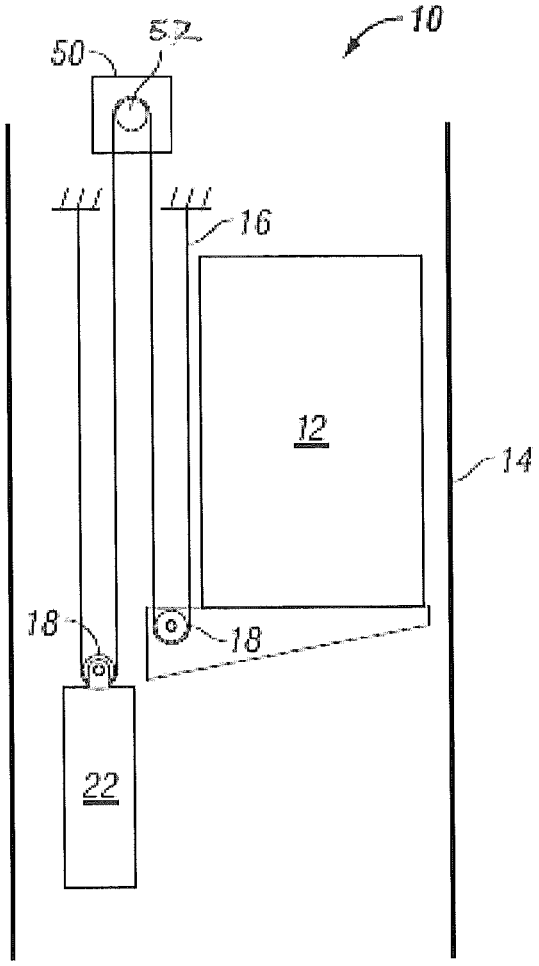
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 52. The traction sheave 52 is driven by a machine 50. Movement of drive sheave by the machine 50 drives, moves and/or propels (through traction) the one or more belts 16 that are routed around the traction sheave 52.

At least one of the sheaves 18 could be a diverter, deflector or idler sheave. Diverter, deflector or idler sheaves are not driven by a machine 50, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIG. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room. The number of sheaves 18 used in the arrangement determines the specific roping ratio (e.g. the 2:1 roping ratio shown in FIGS. 1B and 1C or a different ratio). FIG. 1C also provides a so-called rucksack or cantilevered type elevator. The present invention could also be used on elevator systems other than the exemplary types shown in FIGS. 1A, 1B and 1C.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

Figure 2:
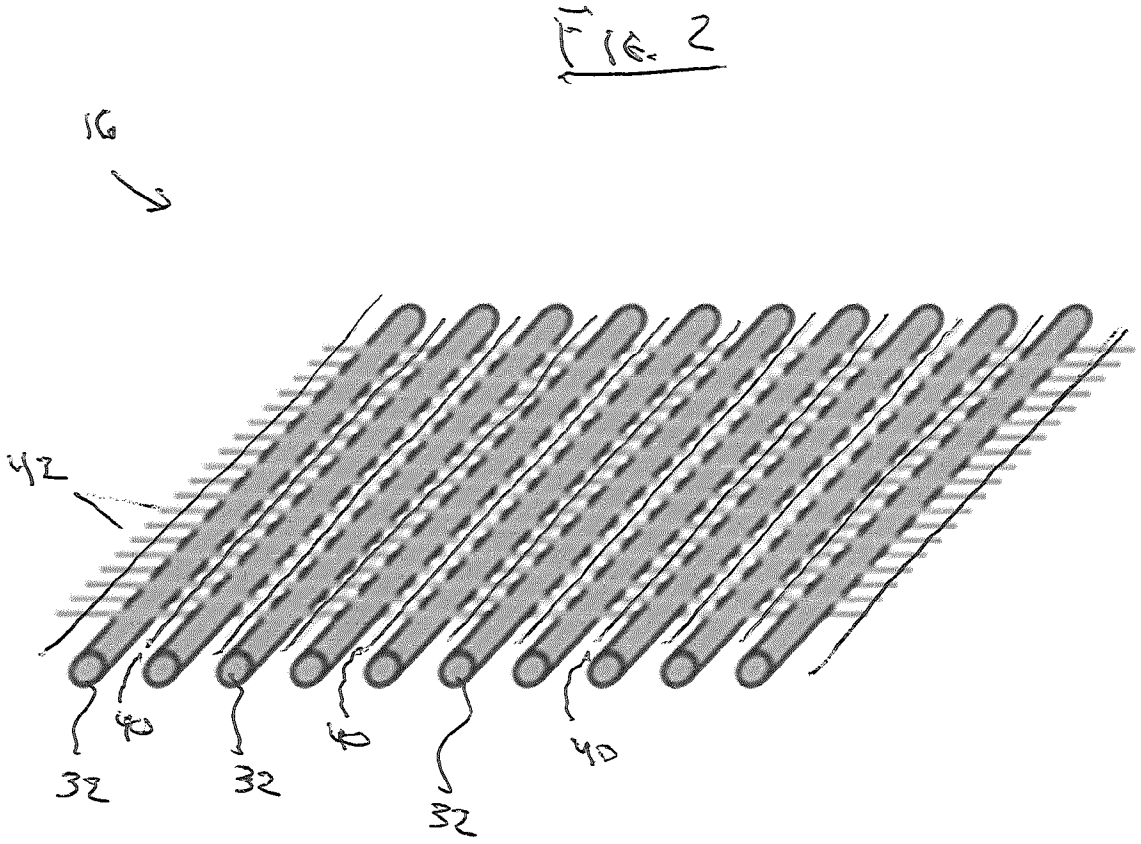
FIG. 2 is a plan view of an embodiment of an elevator belt.
Figure 3:
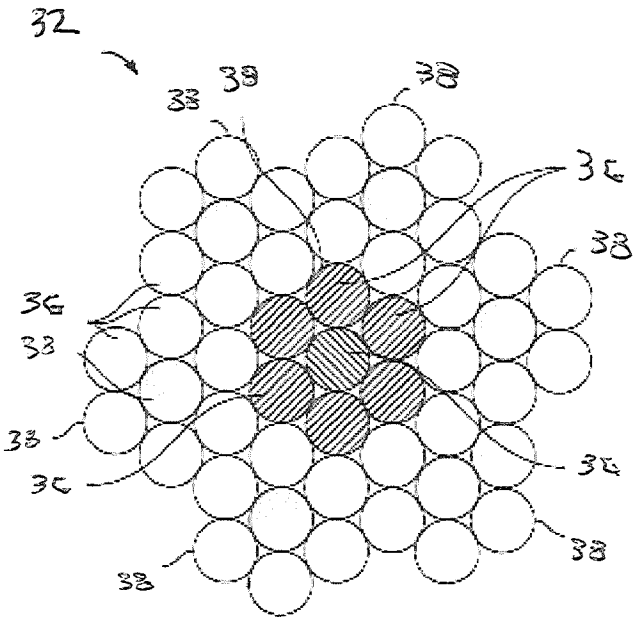
FIG. 3 is a cross-sectional view of an embodiment of a tension element of an elevator belt.

FIG. 2 provides a schematic of an exemplary belt 16 construction or design. The belt 16 includes a plurality of tension elements 32 extending longitudinally along the belt 16. As shown in FIG. 3, in some embodiments, the tension elements 32 are cords formed from a plurality of steel wires 36, which may be arranged into strands 38. Referring again to FIG. 2, the tension elements 32 are arranged generally parallel to each other and extend in a longitudinal direction that establishes a length of the belt 16. The tension elements 32 are woven, knitted or braided with one or more types of fibers to form a composite belt 16. In one embodiment, shown in FIG. 2, the fibers include a plurality of warp fibers 40 extending longitudinally parallel to the tension elements 32 and a plurality of weft fibers 42 extending laterally across the belt 16, at an angle of 90 degrees relative to the tension elements 32 and the warp fibers 40. The tension elements 32, warp fibers 40 and weft fibers 42 are interlaced into a woven structure, which in some embodiments also includes one or more edge fibers 50 extending parallel to the tension elements 32. While in FIG. 2, the weft fibers 42 are at a 90 degree angle relative to the warp fibers 40 and the tension elements 32 and woven together, it is to be appreciated that other angles and other methods of interlacing the tension elements 32 with the fibers 40, 42 may be utilized in forming the belt 16. These methods include, but are not limited to, knitting and braiding. In some embodiments, more than one of the above methods may be utilized to form the belt 16.

In some embodiments, the warp fibers 40 and the weft fibers 42 are formed from one or more of nylon, polyester, polyethylene terephthalate, polyether ether ketone, glass, Kevlar® poly-para-phenylene terephthalamide, aramid, carbon fiber, and wool. These fibers 40 and 42 can be filled or treated to tailor their properties to achieve greater traction, fire resistance, corrosion resistance and mechanical performance. It is to be appreciated that those materials listed are merely exemplary and other fiber materials may be utilized.

Referring to FIG. 4, a coating 44 is applied to the belt 16, at least partially covering and/or encapsulating the composite structure of the tension elements 32, the warp fibers 40 and the weft fibers 42. The coating 44 comprises a base material 46, and in some embodiments includes one or more additives 48 to tailor or enhance certain properties of the coating 44 and/or the belt 16 as a whole. Examples of base materials for the coating 44 include, but are not limited to polyurethane, styrene butadiene rubber (SBR), nitrile rubber (NBR), acrylonitrile butadiene styrene (ABS), SBS/SEBS plastics, silicone, EPDM rubber, or neoprene each of which can be in the form of a solution, emulsion, prepolymer or other fluid phase. As stated, the coating 44 may also include one or more additives 48 to improve characteristics of the belt 16. To improve traction performance of the belt 16, additives 48 such as alumina, silica, titania, graphite or chopped fiber are added. To improve fire resistance, melamine salts, graphene, clay, talc, Al/Mg hydroxide, chopped fiber or exfoliated clay platelets may be added. Corrosion resistance may be improved by adding zinc powder, graphene or exfoliated clay platelets. Mechanical performance may be improved via the addition of chopped fiber, alumina, silica, carbon black, carbon nanotubes or clay. UV resistance of the belt is improved with the addition of carbon black, graphene or carbon nanotubes. It is to be appreciated that the additives 48 listed herein are merely exemplary and other materials may be utilized. Further, such additives 48 are not limited to use in the coating 44, but may also be included in the warp fibers 40 and/or the weft fibers 42.

Figure 5:
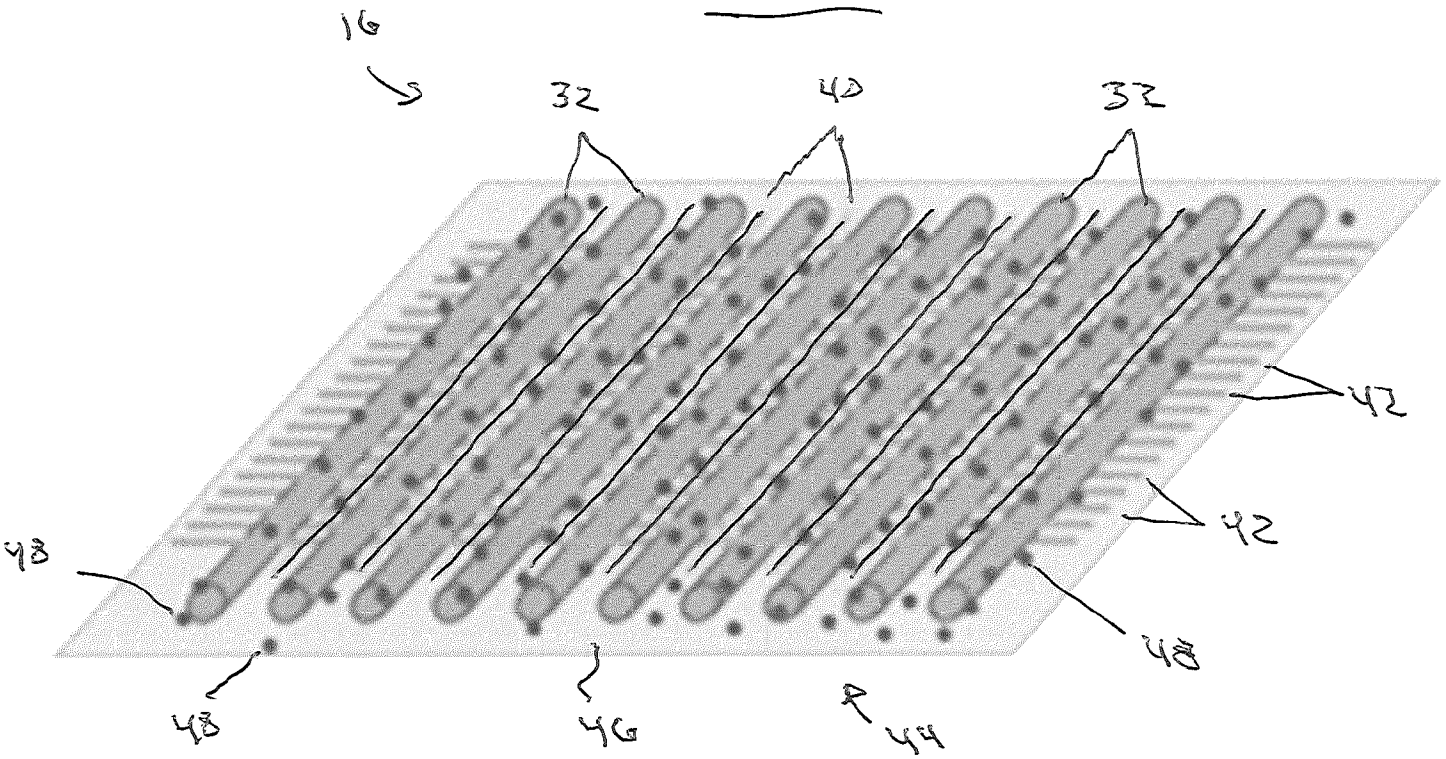
FIG. 5 is a schematic view of an embodiment of a method for making an elevator belt.
Figure 5:
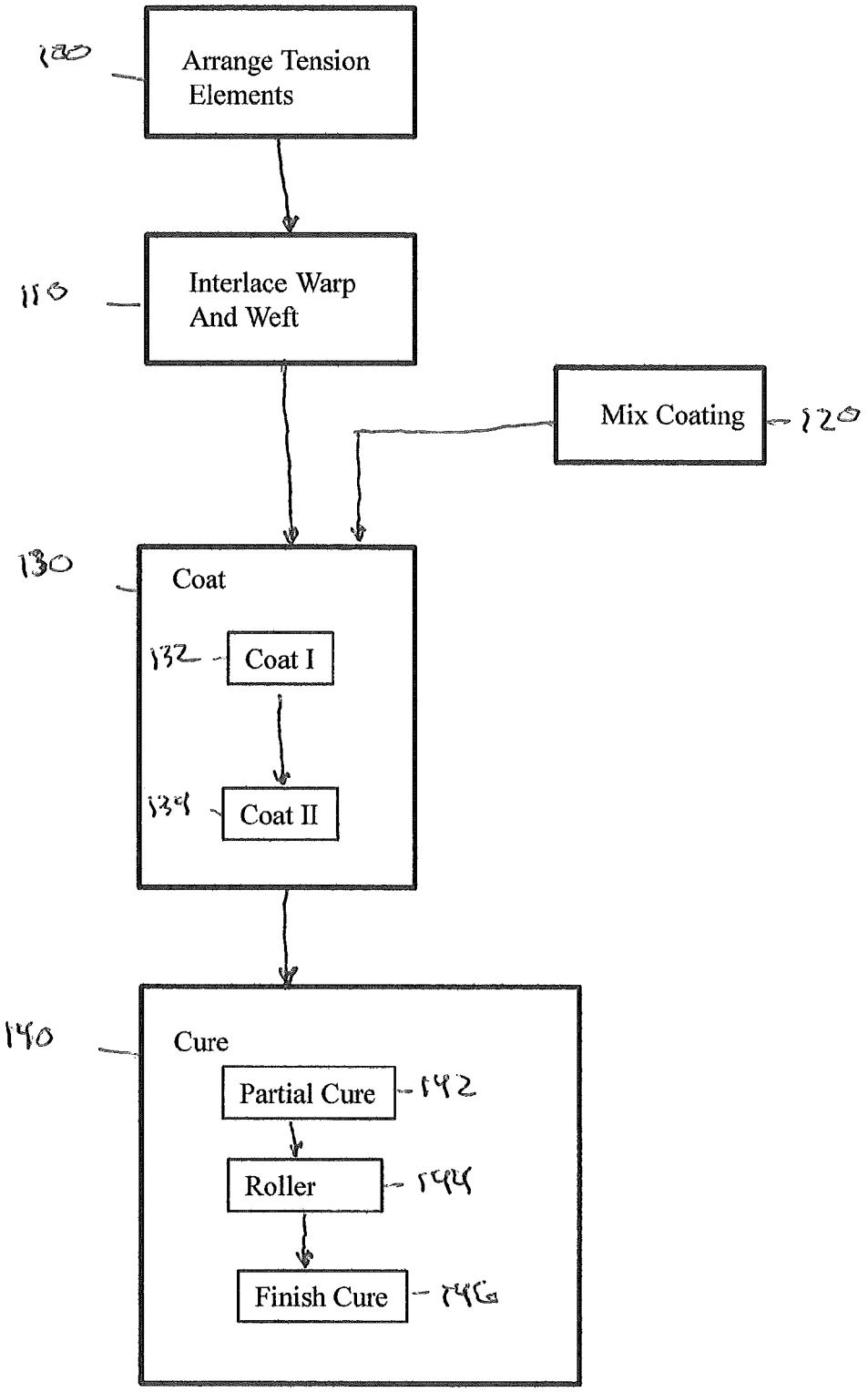

FIG. 5 schematically illustrates an embodiment of a method for making a belt 16 according to the present disclosure. In block 100, the tension elements 32 are arranged longitudinally parallel to one another. In some embodiments, a coating is applied to the tension elements 32 and cured, resulting in a sleeve around each tension element 32. In block 110 the warp fibers 40 and the weft fibers 42 are interlaced with the tension elements 32 by, for example, weaving, braiding or knitting. The coating base 46 is mixed with the additives 48 at block 120. Generally in block 130, the coating 44 is then applied to the composite belt 16 structure by, for example, dipping, spraying, squeezing, rolling, blade coating or pulltrusion of the coating 44 onto the belt 16. The coating 44 is then cured at block 140 by, for example, heating and/or drying. In some embodiments, the coating 44 is applied in two or more distinct steps as depicted at block 132 and block 134. For example, at block 132 a relatively low viscosity coating layer 44*a* is applied to the belt 16. The coating layer 44*a* penetrates and fills gaps in the belt 16 structure. A relatively high viscosity coating layer 44*b* is then applied over coating layer 44*a* at block 134 to build up thickness of the belt 16 and to fill any pores in the coating and improve coating surface finish. In some embodiments, coating layer 44*a* may be at least partially cured before application of coating layer 44*b*. While two coating layers 44*a* and 44*b* are described herein, it is to be appreciated that in other embodiments three or more coating layers may be utilized.

In some embodiments, the coating 44 is partially cured at block 142, then manipulated by, for example, passing the belt 16 through rollers to produce a selected surface finish on the belt 16 at block 144. The rollers may smooth the belt 16 or alternatively apply a selected texture to the belt to produce the selected surface finish. The cure of the belt 16 is then finished at block 146.

The belt 16 of the present disclosure offers numerous benefits. The belt 16 properties are tunable by varying fiber 40 and 42 materials as well as base coating 46 and additive 48 materials. A greater variety of additive 48 materials may be utilized due to tunable coating/additive and fiber/additive interactions. The belt 16 further improves fire resistance, corrosion and/or traction performance.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A belt for suspending and/or driving an elevator car, comprising:

a plurality of tension elements extending longitudinally along a length of the belt;

a plurality of warp fibers and a plurality of weft fibers interlaced with the plurality of tension elements forming a composite belt structure; and a coating at least partially covering the plurality of tension elements, the plurality of warp fibers and the plurality of weft fibers, the coating including:

a base coating material; and at least one additive mixed with the base coating material to improve an operational characteristic of the belt;

wherein the additive includes one or more of alumina, silica, Mania, graphite, chopped fiber, melamine salts, zinc powder, graphene, talc, Al/Mg hydroxide, exfoliated clay platelets, carbon black, carbon nanotubes, or clay;

wherein the coating includes a first coating layer having a first viscosity and a second coating layer applied over the first coating layer, the second coating layer having a second viscosity greater than the first viscosity.

2. The belt of claim 1, wherein the plurality of warp fibers and the plurality of weft fibers are interlaced with the plurality of tension elements by one or more of weaving, knitting or braiding.

3. The belt of claim 1, wherein:

the plurality of warp fibers extend longitudinally along the length of the belt; and the plurality of weft fibers extend transverse to the plurality of warp fibers at a ninety degree angle to the plurality of warp fibers; and an edge fiber extends parallel to the plurality of tension elements.

4. The belt of claim 1, wherein the plurality of warp fibers and the plurality of weft fibers comprise one or more of nylon, polyester, polyethylene terephthalate, polyether ether ketone, glass, poly-para-phenylene terephthalamide, aramid, carbon fiber, or wool.

5. The belt of claim 1, wherein the base coating material comprises one or more of polyurethane, styrene butadiene rubber (SBR), nitrile rubber (NBR), Acrylonitrile butadiene styrene (ABS), SBS/SEBS plastics, silicone, EPDM rubber, or neoprene.

6. The belt of claim 1, wherein the additive including one or more of alumina, silica, titania, graphite or chopped fiber is configured to improve traction performance of the belt.

7. The belt of claim 1, wherein the additive including one or more of melamine salts, graphene, clay, talc, Al/Mg hydroxide, chopped fiber or exfoliated clay platelets is configured to improve fire resistance of the belt.

8. The belt of claim 1, wherein the additive including one or more of zinc powder, graphene or exfoliated clay platelets is configured to improve corrosion resistance of the belt.

9. The belt of claim 1, wherein the additive including one or more of chopped fiber, alumina, silica, carbon black, carbon nanotubes or clay is configured to improve mechanical performance of the belt.

10. The belt of claim 1, wherein the additive including one or more of carbon black, graphene or carbon nanotubes is configured to improve UV resistance of the belt.

11. The belt of claim 1, wherein the plurality of tension elements are a plurality of steel cords.

12. A method of forming a belt for suspending and/or driving an elevator car comprising:

arraying a plurality of tension elements longitudinally along a belt;

interlacing a plurality of warp fibers and a plurality of weft fibers with the plurality of tension elements to form a composite belt structure;

applying a coating to at least partially encapsulate the plurality of tension elements, the plurality of warp fibers and the plurality of weft fibers, the coating including:

a base coating material; and at least one additive mixed with the base coating material to improve an operational characteristic of the belt;

wherein the additive includes one or more of alumina, silica, titania, graphite, chopped fiber, melamine salts, zinc powder, graphene, talc, Al/Mg hydroxide, exfoliated clay platelets, carbon black, carbon nanotubes or clay;

wherein the coating includes a first coating layer having a first viscosity and a second coating layer applied over the first coating layer, the second coating layer having a second viscosity greater than the first viscosity.

13. The method of claim 12, further comprising curing the coating by heating and/or drying the belt.

14. The method of claim 12, further comprising applying a tension element coating to the plurality of tension elements prior to interlacing the plurality of warp fibers and the plurality of weft fibers therewith.

15. The method of claim 12, wherein the coating is applied to the composite belt structure via one of dipping, spraying, rolling, squeezing, blade coating or pulltrusion.

16. The method of claim 12, wherein the first coating layer penetrates the composite belt structure.

17. The method of claim 12, further comprising at least partially curing the first coating layer before applying the second coating layer.

18. The method of claim 12, wherein the plurality of warp fibers and the plurality of weft fibers are interlaced with the plurality of tension elements by one or more of weaving, knitting or braiding.

19. The method of claim 12, further comprising:

partially curing the coating;

passing a roller over the belt surface to produce a selected surface finish of the coating; and finishing cure of the coating.

* * * * *